US005167522A

United States Patent [19]

Behning

[11] Patent Number: 5,167,522

[45] Date of Patent: * Dec. 1, 1992

[54] LOCKING MULTIPLE CONDUCTOR ELECTRICAL CONNECTOR

[75] Inventor: Christian D. Behning, Brockton, Mass.

[73] Assignee: Alden Products Company, Brockton, Mass.

[ * ] Notice: The portion of the term of this patent subsequent to Nov. 26, 2008 has been disclaimed.

[21] Appl. No.: 795,488

[22] Filed: Nov. 21, 1991

Related U.S. Application Data

[63] Continuation-in-part of Ser. No. 659,898, Feb. 25, 1991, Pat. No. 5,067,909.

[51] Int. Cl.[5] ..... H01R 4/54

[52] U.S. Cl. ..... 439/315

[58] Field of Search ..... 439/312, 313, 314, 315, 439/345; 285/314

[56] References Cited

U.S. PATENT DOCUMENTS 4,277,125 7/1981 Ball ..... 439/315 X
4,479,689 10/1984 Marmillion et al. ..... 439/312
4,502,748 3/1985 Brush, Sr. et al. ..... 439/313

FOREIGN PATENT DOCUMENTS 0090480 10/1983 European Pat. Off. ..... 439/312

*Primary Examiner*—Larry I. Schwartz
*Assistant Examiner*—Khiem Nguyen
*Attorney, Agent, or Firm*—James H. Grover

[57] ABSTRACT

A connector for mating a plurality of male and female electrical contacts has two tubular telescoping body portions and an annular collar surrounding them. A spring is confined inside the collar with its ends engaging the collar and a first body portion so as to yieldingly resist rotation of the collar relative to the first body portion. Axially opposed camming tabs on the collar and second body rotate the collar as the bodies are telescoped to a latching position of the tabs locking the connector bodies in mated contact position.

1 Claim, 1 Drawing Sheet

LOCKING MULTIPLE CONDUCTOR ELECTRICAL CONNECTOR

This is a continuation-in-part of application Ser. No. 07/659,898, filed Feb. 25, 1991, now U.S. Pat. No. 5,067,909.

BACKGROUND OF THE INVENTION

With telescopically mating electrical connectors such as a plug and a socket it is often desirable or necessary to lock the two connector bodies together after their conductive contacts have been physically and electrically joined. Single conductor connectors with some form of bayonet joint may be rotated to a locking position. Multiple male and female contacts, however, must be slidingly joined telescopically without rotation, and typically have used a pliable plastic connector body which is deformed as a catch on one connector body rides over a detent on the other connector body to a locking position beyond the detent. If such a deforming latching body is frequently engaged and disengaged the plastic fatigues from the deformation and the latching mechanism fails.

Accordingly it is one object of the present invention to provide an electrical connector with two telescoping bodies which snap into locked position without deformation of the bodies. A further object is to confirm the snap into locked position with an audible or visible indication. Still a further object it to provide an improved mechanism for unlocking and disengaging the mated connector bodies.

SUMMARY OF THE INVENTION

According to the invention an electrical connector comprises first and second tubular connector bodies having telescopingly engaged body portions and axially mating electrical contacts, an annular collar encircling the telescoping body portions and rotatively held on the first body, a spring inside the collar, the ends of the spring being confined between the first body and the collar so as yieldingly to resist rotation of the collar relative to the first body, axially aligned tabs on the collar and second body with opposed flaring cam surfaces producing rotation of the collar relative to the second body as the bodies are telescoped to a mated contact position, the cam surfaces guiding the collar tab around the body tab, the coiled spring yielding as the collar is rotated by the cam tabs during contact mating, and the spring then rotating the collar tab to a latching position axially behind the body tab thereby locking the connector bodies in mated contact position.

DRAWINGS

DESCRIPTION

Figures 1, 2, 3, 4, 5, 6, 7, 8:
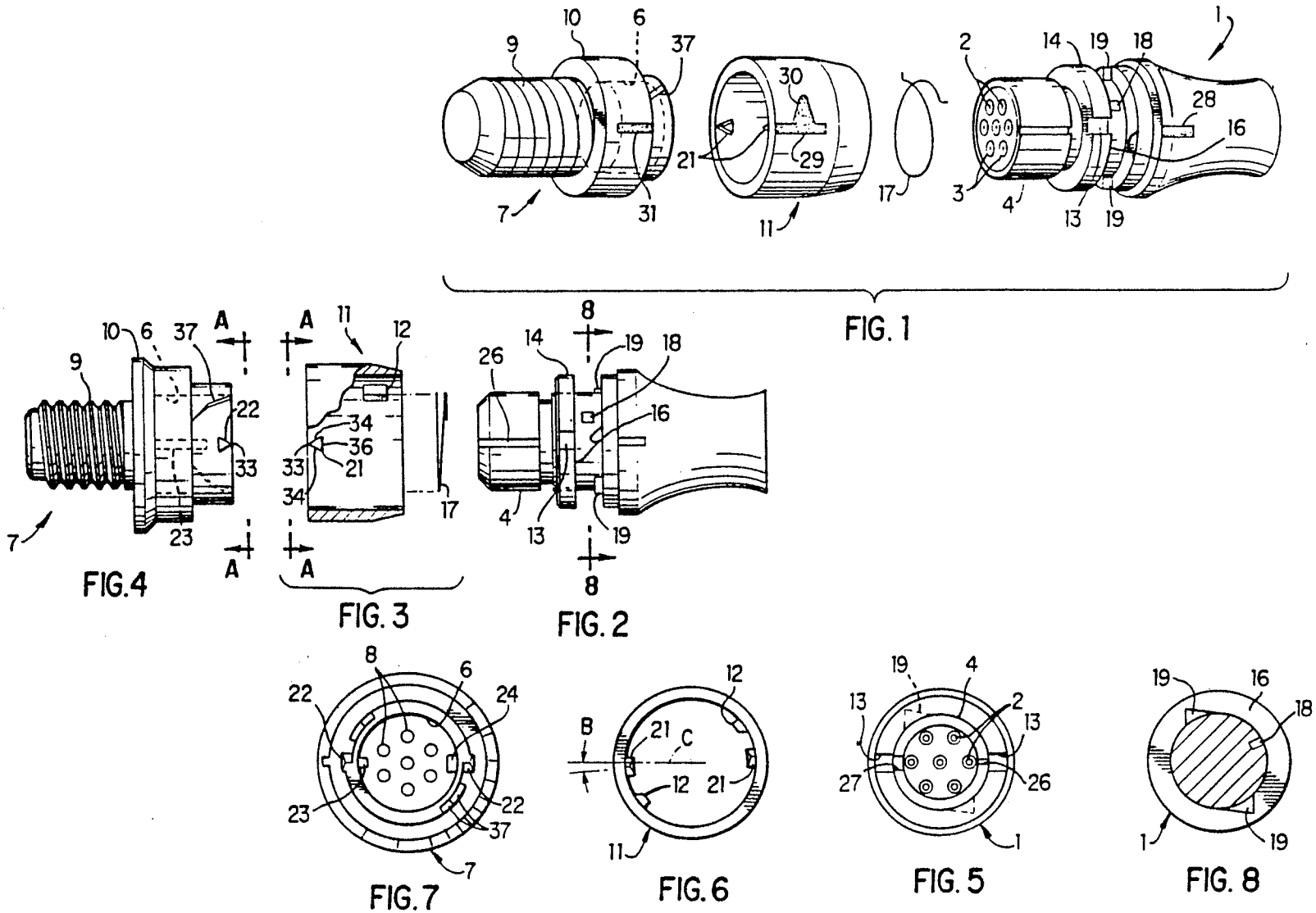
FIG. 1 is an exploded isometric view of a connector according to the invention with first and second connector bodies and a collar.
FIGS. 2, 3, 4 are side elevations, partly in section, of the first body, collar and second body respectively.
FIGS. 5, 6, 7 are end elevations of the first body, collar and second body viewed from a plane A—A between the collar and second body.
FIG. 8 is a section on line 8—8 of FIG. 2.

The seven conductor electrical connector shown in FIG. 1 has a first connector body or plug 1 with male contacts 2 enclosed in recesses 3 of an insulative boss 4 (see also FIGS. 2, 5 and 8). The plug boss telescopes into a cavity 6 of a second connector body or receptacle 7 surrounding female contacts 8 (FIGS. 4 and 7) which axially mate with the male contacts 2. The second body 7 has threads 8 beyond a flange 9 for mounting the second body permanently in a panel with a conventional nut not shown. An annular collar 11 encircles the boss 4 of the first, plug, body and the socket 6 of the second, receptacle body 7 when the two bodies are mated. The collar has internal radial stops 12 which are admitted through passageways 13 in an annular flange 14 on the first body into an annular groove 16 which axially confines the stops and holds the collar rotatively on the first body. The stops limit rotation of the collar to about forty degrees. A coiled spring 17, preferably a round wire of spring metal, also confined in the groove, is anchored at one end inside the collar at one stop 12 and at the other end in a small recess 18 in the groove 16. The spring is biased yieldingly to urge the collar stops 12 always to a normal position in abutment with opposed stops 19 in the groove (FIG. 8). In this normal position of the collar, camming tabs 21 inside the collar are located with respect to the male contacts 2 of the first body such that the tabs 21 and contact 2 are in matching alignment with like camming tabs 22 and the female contact 8 on the second body 7 as will be explained in detail.

With the collar 11 and spring 17 assembled on the plug body 1 the spring yieldingly holds the collar in the normal position in which the collar camming tabs 21 have the same angular relationship to the male contacts on the plug as the receptacle camming tabs 22 have to the female contacts in the receptacle body. To assure that the male contacts are in correct angular alignment during mating engagement, the receptacle cavity 6 has a narrow longitudinal key 23 and a wide key 24 which slide into correspondingly small and large keyways 26 and 27 in the boss 4 of the first, plug, body 1. As a visual aid to the correct angular alignment index marks 28, 29, 31 are embossed and painted on the plug 1, collar 11 and receptacle 7, respectively. The mark on the collar includes an arrowhead 30 indicating the direction in which the collar can be rotated from normal position during the two operations of locking engagement and disengagement of the plug and receptacle.

The operation of locking the plug and receptacle together with mated contacts is effected manually by aligning the index marks 29 and 31 on the collar and receptacle respectively then pushing the two bodies together. At first the collar camming tabs 21 start to slide past the receptacle camming tabs 22. For this purpose each collar camming tab 21 is offset a small angle B, e.g. five degrees, from a central plane through the collar and receptacle. The tabs are pie shaped with opposing points 33 and two camming surfaces 34 flaring away from the point to intersection with a back surface 36. After first sliding engagement the mutual wedging action of the camming surfaces 34 forces the collar to rotate against its spring, allowing the collar tab to slide around the receptacle tab and then spring back with its back surface behind and abutting the back surface of the receptacle tab. In this position the tabs have locked the first, plug body to the second, receptacle body. The spring then reverses rotation of the collar until the faces of the collar stops 12 strike the opposed faces of the plug stops 19 with an audible snap signalling that the plug and receptacle are locked together. Locking is confirmed visually by alignment of the index marks 29 and 31 after the automatic return of the collar to its normal position by the spring.

To disengage the first and second bodies the collar is manually rotated in the direction of its arrowhead 30. The camming tabs 21 in the collar are thereby turned toward circumferential ramps 37 slanting across the paths of the tabs. The camming face of each ramp 37 is angled away from the adjacent tab so that it cams the collar tab, collar and first body apart and out of engagement. Disengagement is therefor effected without pulling and straining the cord extending from the plug 1, because rotation of the collar is in a plane at right angles to the axis of the plug and cord.

The rotating collar and camming tabs of the connector provide automatic locking engagement of the plug and socket without deformation of the plastic, insulative connector bodies or collar. Engagement is indicated positively by an audible snap and by alignment of index marks. The spring allows a rotary disengaging manipulation which is convenient and which places no longitudinal strain on a cord or cable connected to the plug body.

It should be understood that the present disclosure is for the purpose of illustration only, and that the invention includes all modifications and equivalents falling within the appended claims.

I claim:

1. A coupling connector comprising:

first and second tubular connector bodies having telescopingly engaged body portions and axially mating contacting portions;

an annular collar encircling the telescoping body portions and rotatively held on the first body;

a spring inside the collar, the ends of the spring being confined between the first body and the collar so as yieldingly to resist rotation of the collar relatively to the first body;

axially opposed tabs on the collar and second body with opposed flaring cam surfaces cooperatively producing rotation of the collar relative to the second body as the bodies are telescoped to a mated contacting position, the cam surfaces guiding the collar tab around the body tab; and the coiled spring yielding as the collar is rotated by the cam tabs during contact mating, and the spring then rotating the collar tab to a latching position axially behind the body tab locking the connector bodies in mated contacting position.

* * * * *